US006511072B1

(12) United States Patent
Santa Cruz et al.

(10) Patent No.: US 6,511,072 B1
(45) Date of Patent: Jan. 28, 2003

(54) CARD GAME

(76) Inventors: Cathy D. Santa Cruz, 7630 Tholl Dr., Reno, NV (US) 89506; Patrick Phommabouth, 1511 Pioneer Rd. #11, Cresthill, IL (US) 60435; Richard Naumann, 2559 Grant Park Ct., Cresthill, IL (US) 60435

( * ) Notice: Subject to any disclaimer, the term of this patent is extended or adjusted under 35 U.S.C. 154(b) by 0 days.

(21) Appl. No.: 09/986,228

(22) Filed: Oct. 22, 2001

(51) Int. Cl.[7] ..... A63F 1/00; A63F 9/20
(52) U.S. Cl. ..... 273/292
(58) Field of Search ..... 273/292, 274; 463/12, 13

(56) References Cited

U.S. PATENT DOCUMENTS 5,362,064 A * 11/1994 Lofink et al. ..... 273/274
5,366,228 A * 11/1994 Kangsanaraks ..... 273/292
5,496,038 A * 3/1996 Kangsanaraks ..... 273/292
5,529,309 A * 6/1996 Bartlett ..... 273/292
5,653,445 A * 8/1997 Quach ..... 273/274
5,806,854 A * 9/1998 Coleman et al. ..... 273/274
5,839,731 A * 11/1998 Feola ..... 273/292
5,979,896 A * 11/1999 Lofink et al. ..... 273/274
6,299,171 B1 * 10/2001 Mollo et al. ..... 273/292

OTHER PUBLICATIONS

John Scarne, Scarne's Encyclopedia of Games, 1973, Harper & Row, pp. 290–302.*
"California Baccarat", Casino Gaming Concepts Inc., product brochure, 1994, 273/292 1994.*

* cited by examiner

*Primary Examiner*—S. Thomas Hughes
*Assistant Examiner*—Alex F. R. P. Rada, II

(57) ABSTRACT

A card game that can be played by any amount of players of any age group, with the only skill required being the knowledge of addition and recognizing a standard deck of playing cards. Also, the game is substantially similar to "poker" and "blackjack" in combination yet the players are dealt only three cards with the object being to obtain a sub-total of nine or the closest thereto, and the players win if they beat the dealer.

2 Claims, 1 Drawing Sheet

CARD GAME

FIELD OF THE INVENTION

This invention relates to card games in general but more particularly pertains to a card game that is somewhat similar "blackjack" and "poker" combined. However, the object of the game is to obtain a total of 9 (nine) points, or the closest thereto, and/or a high/low/nine jackpot and/or specified poker prize jackpot using only three cards. The game is played between a dealer and at least one player and utilizes a standard 52-card deck. The game further includes tracking means for jackpots and wagering status. Also, the game is strictly a game of chance and skill is not required by the players.

BACKGROUND OF THE INVENTION

Gambling has become very popular over the years, especially recently as there has been a noticeable increase of many additional states which now offer legalized gambling. Card games used in gambling are traditionally limited to "blackjack" also known as "21", "poker" and the like. Such games have been played in the casinos for many years and therefore unfortunately they are losing their novelty and popularity. While the rules of these games may vary, they are all somewhat similar as in each case the player must be skilled in order to play the game.

Card room poker games are generally played between the players and each player is competing against his fellow players, not against the house. Therefore, casinos have become very popular as many people prefer to win money from an impersonal source, such as the house or the casino rather than from their fellow players with whom they may be acquainted.

It is therefore contended that there is a need for a new type of card game which can be played at home, on television, at the casino, etc., and will provide individuals with many hours of recreational fun. It is also important that such a game should be simplistic and easy to learn so that family members of all ages can compete and enjoy the objects of the game together.

SUMMARY OF THE INVENTION

It is therefore an object of the present invention to provide a card game which can be played by an unlimited amount of players at one time.

It is another object of the present invention to provide a simplified card game which can be played by anyone, no matter what age they may be, as the game dos not require any skill other than adding the total value of the cards.

Another object of the present invention is to provide a card game which is very appealing to casinos, as the odds of winning are highly favorable for the house.

Yet another object of the present invention is to provide a card game which can be played either at home, on TV, on a radio show, at a casino, etc. It is to be noted that in each case the rules may vary as the rules are subject to change respective to the location or media to be used.

Also another object of the present invention is to provide a card game that is simple to play, is non-intimidating, and offers the player an opportunity to win a substantial amount of cash.

It is an object of the present invention to utilize a standard deck of playing cards excluding any jokers.

It is another object of the present invention is to provide a new and exciting card game which incorporates the best features of "Poker", "Keno", "Bingo", etc.

Still another object of the present invention is to provide a card game which does not require additional manufacturing costs, such as specialized machinery or the like.

DETAILED DESCRIPTION OF THE DRAWINGS

Figure 1:
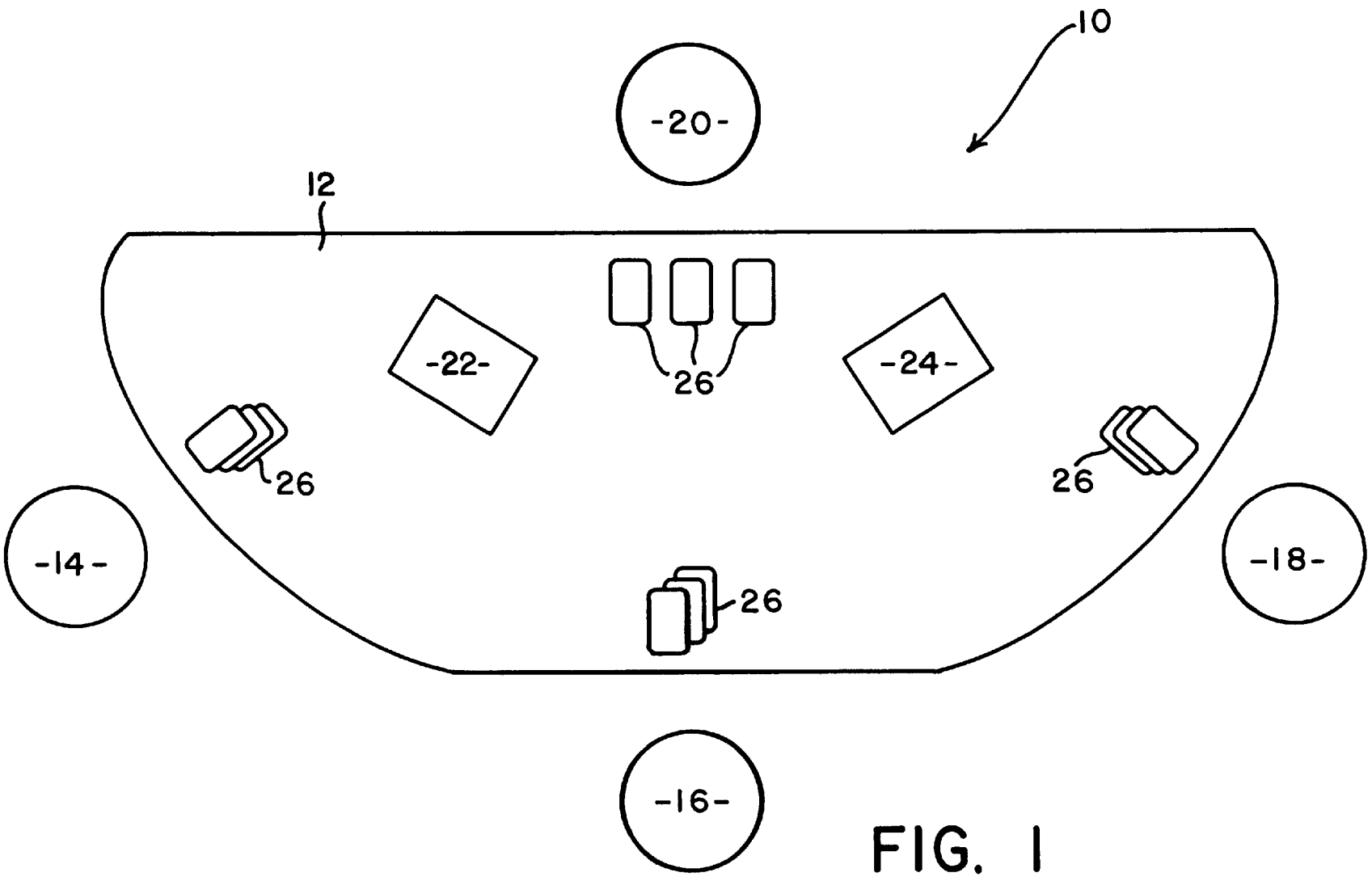
FIG. 1 substantially illustrates a plan view for playing the card game of the present invention.

Referring now in detail to the drawing wherein like characters refer to like elements throughout the view. In FIG. 1 (10) substantially represents an overview of the present invention which is a card game and can be played by any number of players, and anyone who can add and read a standard deck of playing cards can play.

The card game (10) can be provided in various versions of manufacturing choice, such as the card game (10) can be produced for home or casino use, or the game can be shown and played on other types of media, such as on a radio show, TV game show, on the internet, lotto, etc.

Therefore, we will herein explain the preferred version within the following specification but it is to be understood the card game (10) is not to be limited to the version as taught herein but shall include inherent versions as well.

Referring now to the preferred version as depicted in FIG. 1, wherein shown is a table (12) which can be any suitable table of players choice that allows the players plenty of space for play and comfort. In this illustration, the table (12) is set up for three players to play, namely a first player (14), a second player (16), a third player (18), and a dealer (20), but it is to be understood any amount of players can play.

The dealer is in charge of the bank, and it is the dealer's responsibility to make sure every player has placed their bet before the start of the game and then pay the winners accordingly thereafter. The dealer is also responsible for shuffling the deck and then placing the cards appropriately (later described) on table (12).

The game is played with a typical standard deck of 52 playing cards without any jokers. It is to be understood each player may play as many hands as they wish, but for simplicity we only show one hand for each player.

To play the game, dealer (20) first determines an appropriate pay scale. It is to be understood the game may be played with any type of suitable reward of choice, such as poker chips, candy, money, or the like, but for illustrative purposes we will hereafter use money.

For example, if a player wagers $1.00 for the hand and that player wins, the dealer would pay the winner $1.00. If the player wagers $5.00 for the hand and that player wins, the dealer would pay the winner $5.00, etc.

Each player places their bet at an appropriate location on the table (12). It is to be understood that table (12) may include two additional winning jackpots, such as a high/low/nine jackpot (22) and a poker prize jackpot (24). Whereby, if a player places money in either jackpot or both (22 & 24), they can win in three different ways later described.

The object of the game is to beat the dealer (20) by simply having a total of 9, or a total that is closer to 9 than the dealer (20). It is to be understood that each card counts as its face value, with the exception of the ace which is always counted as one, and all face cards being counted as ten, and each player (14, 16 & 18) receive three cards total. Also, when the total values of the three cards are added together and the sum results in a two digit total, the first digit is to be disregarded.

For example, if a player is dealt a hand consisting of the two of spades, the two of diamonds, and the four of hearts, the total count for their hand would be 8, (2+2+4=8). If a player is dealt a hand consisting of the three of spades, the four of diamonds, and the queen of hearts, the total count for their hand would be 17, (3+4+10=17), disregarding the first digit would make the total 7. If the player is dealt three face cards, the total would be 30, (10+10+10=30), yet when disregarding the first digit, the total would be 0 (zero). Therefore, no matter what cards are dealt, none of the players will ever have a total higher than 9.

As previously noted the game may include high/low/nine jackpot (22). Whereby, if a player places monies thereon, and they are dealt three cards consisting of the queen of spades for a value of 10, the five of hearts for a value of 5, and the four of diamonds for a value of 4, the total would be nine (10+5+4=19, disregarding the first digit would make the total 9). Thus, the player having a total of nine with a ten card value, automatically wins the high/low/nine jackpot (22).

If a player is dealt the two of spades, the six of diamonds, and the ace of clubs, the total would be nine (2+6+1=9). Thus, the player having a total of nine without a ten card value card, will automatically win the high/low/nine jackpot (22) may also be won if the player simply has a natural nine (9) in their hand.

As previously noted the game may include a poker prize jackpot (24). Whereby, if a player places monies thereon, and they are dealt a three card hand consisting of either a pair, a three of a kind, a flush, or a straight flush, they will automatically win the poker prize jackpot (24). It is to be also understood that if there are multiple winners per game, the player with the best hand wins the appropriate jackpot, either (22 & 24) or both.

To play the game, first the players (14, 16 & 18) place their bets for their hand respective of any dollar amount of their choice, the players (14, 16, & 18) also place bets for either jackpot (22 or 24) or both is\f they wish. After all bets are made, the dealer (20) can begin the game by first shuffling the cards (26) and then dealing the cards as follows:

The first of the cards (26) is dealt face up to the first player (14), the second card is dealt face up to the second player (16), the third card is dealt face up to the third player (18), the fourth card is dealt face up to the dealer (20), this pattern is repeated until each player (14, 16 & 18) and the dealer (20) each have three cards. Thereafter, the dealer (20) determines the winners and pays them accordingly. The winners are not only paid for the winning hand but also for each of the additional jackpots (22 & 24) if there is a winner. Finally, the dealer (20) gathers the loser's bets for addition to the house bank. It is to be noted if there is no winner for either of the jackpots (22 & 24), the monies remain in the jackpots (22 & 24) until there is a winner.

It is to be understood this game can be played in a variety of ways and the example as taught herein is only exemplary as the invention is not to be limited to the rules as provided, but is to include any obvious variants thereof.

We now provide a method for playing a card game comprising the steps of:

a. determining values for a standard deck of 52 playing cards (26), with the values being: ace=1, king=10, queen=10, jack=10, and all remaining cards (26) keeping their face value;

b. placing bets for the winning hand by all players;

c. providing a dealer with a standard deck of 52 playing cards (26);

d. shuffling cards (26) by the dealer (20);

e. dealing cards (26) one at a time until all players (14, 16 & 16) and dealer (20) each have a total of three cards (26);

f. determining the sub-total of the first players hand (14), with the sub-total being calculated by adding together the total points of all three cards (26), if sub-total is a two digit number then the first digit is disregarded.

g. Determining the sub-total of the dealers (20) hand as described above;

h. Determining if the first players hand (14) has a sub-total closer to 9 than the sub-total of the dealers (20) hand; if the sub-total of the first players hand (14) is closer to nine than the sub-total of the dealers (20) hand, the dealer (20) pays the first player (14), if the sub-total of the dealers (20) hand is closer to nine than the sub-total of the first players hand (14), the dealer (20) then gathers the first players bet for addition to the house bank; and;

i. repeating steps f–h until all players (14, 16 & 18) have either won or lost the game.

As previously noted the game may include a high/low/nine jackpot (22), wherein the second method of play further includes the following additional steps:

Between steps "b" and "c" above, the method further includes placing bets pertaining to a high/low/nine jackpot (22), and after step "i" we further include step "k" which states "determining if any of all players (14, 16 & 18) have won the high/low/nine jackpot (22) being won when any of all players (14, 16 & 18) have a sub-total of nine with one of three cards (26) being either a king, queen, or jack (a high jackpot) or when any of all players (14, 16 & 18) have a sub-total of nine without a king, queen, or jack, (a low jackpot) or when any of all players (14, 16 & 18) have a natural nine card, and the final step "l" provides paying the winner of high/low/nine jackpot (22), and if there is more than one winner then high/low/nine jackpot (22) is equally distributed there between."

As previously noted, the game may include a poker prize jackpot (24), wherein the third method of play further includes the following additional steps:

Between "b" and "c" above, the method further includes placing bets pertaining to a poker prize jackpot (24), and after step "i" we further include step "k" which states "determining if any of players (14, 16 & 18) have a poker hand comprising of either a pair, a three of a kind, a straight, a flush, or a straight flush and step (l) teaches paying the winner of poker prize jackpot (24), and if there is more than one winner then poker prize jackpot (24) is paid to the player having the highest poker hand."

We further provide a fourth method of play wherein the noted jackpots (22 & 24) are both included in the game, wherein between steps "b" & "c" of the first method we include step "c", "placing bets pertaining to a high/low/nine jackpot (22)" and step "d" "placing bets pertaining to a poker prize jackpot (24)," and after step "i" of the first method we further includes steps "l" determining if any of all players (14, 16 & 18) have won the high/low/nine jackpot (22)", with high/low/nine jackpot (22) being won when any of all players (14, 16 & 18) have a sub-total of nine with one of three cards (26) being either a king, queen, or jack, (a high jackpot) or when any of all players (14, 16 & 18) have a sub-total of nine without a king, queen, or jack, (a low jackpot) or when any of all players (14,_16 & 18) have a natural nine card, and step "m" including "paying the winner of high/low/nine jackpot (22), if there is more than one winner then high/low/nine jackpot (22) is equally distributed there between," and step "n", "determining if any of all players (14, 16 & 18) have won the poker prize jackpot (24), with poker prize jackpot (24) being won when any of all players (14, 16 & 18) have a poker hand comprising of either a pair, a three of a kind, a straight, a flush, or a straight flush, and step (o) teaches paying the winner of poker prize jackpot (24), and if there is more than one winner then poker prize jackpot (24) is paid to the player having the highest poker hand."

It will now be seen we have herein provided a version of the card game (10) which can be played at home, at a casino, on TV, on a radio show, on the internet, etc., which is fun and very entertaining.

It can now be seen we have herein provided a new and novel card game which can be played by numerous players, and can be produced in various versions according to engineering choice.

It will also be seen we have herein provided a card game which can be played in a variety of ways, such as the cards may be dealt face-up or face-down, the pattern of dealing may be of dealers choice, it may include additional jackpots if so desired, etc.

Although the invention has been herein shown and described as what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatus.

Having described the invention what we claim as new and wish to secure by Letters Patent is:

1. A method for playing a card game comprising the steps of:

a. determining values for a standard deck of 52 playing cards, with said values being: Ace=1, king=10, queen=10, jack=10, and all remaining said cards keeping their face value;

b. placing bets pertaining to a winning hand by all players;

c. placing bets pertaining to a high/low/nine jackpot by said all players;

d. providing a dealer with said standard deck of 52 playing cards;

e. shuffling said cards by said dealer;

f. dealing said cards one at a time until said all players and said dealer each have a total of three said cards;

g. determining the sub-total of a first players hand, said sub-total being calculated by adding together the total points of all three cards, if said sub-total is a two digit number then the first digit is disregarded;

h. repeating step g to determine the sub-total of the dealers hand;

i. determining if said first players hand has a sub-total closer to nine than said sub-total of the dealers hand; if said sub-total of said first players hand is closer to nine than said sub-total of said dealers hand, said dealer pays the first player, if said sub-total of said dealers hand is closer to nine than said sub-total of said first players hand, said dealer gathers the first players bet for addition to the house bank;

j. repeating steps f–h until said all players have either won or lost;

k. determining if any of said all players have won said high/low/nine jackpot, said high/low/nine jackpot is won when any of said all players have a said sub-total of nine with one of said three cards being either a king, queen, or jack, or when any of said all players have a said sub-total of nine without a king, queen, or jack, or when any of said players have a natural nine card; and;

l. paying the winner of said high/low/nine jackpot, if there is more than one winner then said high/low/nine jackpot is equally distributed there between.

2. A method for playing a card game comprising the steps of:

a. determining values for a standard deck of 52 playing cards, with said values being: Ace=1, king=10, queen=10, jack=10, and all remaining said cards keeping their face value;

b. placing bets pertaining to a winning hand by all players;

c. placing bets pertaining to a high/low/nine jackpot by said all players;

d. placing bets pertaining to a poker prize jackpot by said all players;

e. providing a dealer with said standard deck of 52 playing cards;

f. shuffling said cards by said dealer;

g. dealing said cards one at a time until said all players and said dealer each have a total of three said cards;

h. determining the sub-total of a first players hand, said sub-total being calculated by adding together the total points of all three cards, if said sub-total is a two digit number then the first digit is disregarded;

i. repeating step h to determine the sub-total of the dealers hand;

j. determining if said first players hand has a sub-total closer to nine than said sub-total of the dealers hand; if said sub-total of said first players hand is closer to nine than said sub-total of said dealers hand, said dealer pays the first player, if said sub-total of said dealers hand is closer to nine than said sub-total of said first players hand, said dealer gathers the first players bet for addition to the house bank;

k. repeating steps f–h until said all players have either won or lost;

l. determining if any of said all players have won said high/low/nine jackpot, said high/low/nine jackpot is won when any of said all players have a said sub-total of nine with one of said three cards being either a king, queen, or jack, or when any of said all players have a said sub-total of nine without a king, queen, or jack, or when any of said players have a natural nine card;

m. paying the winner of said high/low/nine jackpot, if there is more than one winner then said high/low/nine jackpot is equally distributed there between;

n. determining if any of said all players have won said poker prize jackpot, said poker prize jackpot is won when any of said all players have a poker hand comprising of either a pair, a three of a kind, a straight, a flush, or a strait flush; and;

o. paying the winner of said poker prize jackpot, if there is more than one winner then said poker prize jackpot is paid to the player having the highest poker hand.

* * * * *